US005440382A

United States Patent [19]

Suga

[11] Patent Number: 5,440,382

[45] Date of Patent: Aug. 8, 1995

[54] TRANSFER MATERIAL CARRYING CONTROLLING APPARATUS

[75] Inventor: Yoshiharu Suga, Kanagawa, Japan

[73] Assignee: Fuji Xerox Co., Ltd., Tokyo, Japan

[21] Appl. No.: 70,250

[22] Filed: Jun. 2, 1993

[30] Foreign Application Priority Data

Jun. 3, 1992 [JP] Japan ..... 4-142509

[51] Int. Cl.[6] ..... G03G 21/00

[52] U.S. Cl. ..... 355/317; 355/205; 355/271

[58] Field of Search ..... 355/208, 316, 317, 205, 355/207, 271, 272, 274; 271/265, 270

[56] References Cited

U.S. PATENT DOCUMENTS

| | | | |
|---|---|---|---|
| 4,025,187 | 5/1977 | Taylor et al. | 355/317 |
| 4,669,853 | 6/1987 | Sosinski et al. | 355/317 X |
| 4,936,567 | 6/1990 | Fukui | 271/265 X |
| 5,057,874 | 10/1991 | Miyazaki et al. | 355/316 |
| 5,119,146 | 6/1992 | Nobumori et al. | 355/317 |
| 5,136,342 | 8/1992 | Ida et al. | 355/317 |
| 5,222,728 | 6/1993 | Takahashi | 271/265 X |

FOREIGN PATENT DOCUMENTS

| | | |
|---|---|---|
| 55-159460 | 12/1980 | Japan . |
| 0090565 | 3/1992 | Japan . |

*Primary Examiner*—Robert Beatty
*Attorney, Agent, or Firm*—Finnegan, Henderson, Farabow, Garrett & Dunner

[57] ABSTRACT

In a multiplex transfer system image generating device, a transfer material carrying device 14 has a main carrying roll 31 for carrying a transfer material S to a transfer material holder 15, a subsidiary carrying roll 32 for transferring the transfer material to the main carrying roll 31 to generate a loop L, a transfer material detecting sensor 35 provided close to the main carrying roll 31, and a jam judging timer for judging the jam of the transfer material S on the basis of a detection signal of the transfer material detecting sensor 35. The driving timing of the main carrying roll 31 is controlled by a rotation position reference signal of the transfer material holder 15. In the case of adjusting timing to drive the main carrying roll 31, the judging time for the jam judging timer and the timing to drive the subsidiary carrying roll 32 are changed in accordance with the adjusted timing, so as to ensure the optimum quantity of the loop of the transfer material S.

2 Claims, 5 Drawing Sheets

TRANSFER MATERIAL CARRYING CONTROLLING APPARATUS

BACKGROUND OF THE INVENTION

The present invention relates to a transfer material carrying control apparatus in an image generating device such as an electrophotographic copying machine, a printer, a facsimile terminal equipment, and so on, particularly in an image generating device of the system in which multiplex transfer is carried out to generate a color image, a composite image, and so on.

FIG. 6 is a configuration diagram illustrating an example of a color electrophotographic copying machine as an image generating device of the multiple transfer system, which is constituted by an automatic original document supply device 1, an image input portion 2, an image output portion 3, and a transfer material supply portion 4. A color original document is put on a platen glass 5 by the automatic original document supply device 1. The image input portion 2 is constituted by an imaging unit 6, a wire 7 for driving the unit, a driving pulley 9, and so on. By using a CCD line sensor and color filters in the imaging unit 6, in the case of full color of four colors, the image input portion 2 reads the color original document for each of B (blue), G (green) and R (red) colors which are primary colors of light.

After converting the read information into digital image signals, the image input portion 2 converts the reflective factor information into density information. After giving a variety of data processing onto the density information in order to improve the reproducibility of color, gradation, precision and so on, the image input portion 2 further converts the density information into picture element signals of Y (yellow), C (cyan), M (magenta) and K (black) which are primary colors of toner, decides the on-time of laser for every picture element in accordance with the picture element signals, and outputs the picture element signals and the on-time of the laser to the image output portion 3.

The image output portion 3 includes a scanner 10, a photosensitive drum 11 and so on, and the photosensitive drum 11 is surrounded by a charger 12 for electrifying the photosensitive drum 11 uniformly, a developing device 13 for developing an electrostatic latent image into a toner image, a transfer device 15 for transferring the toner image to a transfer material, and a cleaning device 16 for recovering residual toner having not been transferred. The photosensitive drum 11 is driven by an electric motor to rotate in the direction as shown in the illustrated arrow.

For example, a yellow image signal from the image input portion 2 is converted to a light signal in a laser output portion 10*a* of the scanner 10 to thereby generate a latent image corresponding to an original image, on the photosensitive drum 11 through a polygon mirror 10*b*, an f/θ lens 10*c* and a reflection lens 10*d*. If this yellow latent image is transferred to a transfer material after being developed, the photosensitive drum 11 is electrified by the charger 12 after residual toner is removed therefrom by the cleaner 16, and the laser output portion 10*a* outputs a cyan image signal. Thereafter, latent images of the respective image signals of the magenta and black are generated sequentially.

The developing device 13 includes a yellow developer 13Y, a cyan developer 13C, a magenta developer 13M and a black developer 13K, and the respective developers are provided around the rotation axis thereof. Development is performed by the yellow developer 13Y, which is positioned as illustrated, when a toner image of yellow as an example is generated, and the developing device 13 is rotated to move the cyan developer 13C to the position so as be in contact with the photosensitive drum 11 when a toner image of cyan is generated. Development of magenta and black is performed in the same manner as above.

The outer circumference of the transfer drum 15 constituting a transfer material holder is covered with a transfer material carrier constituted by a dielectric sheet, and the transfer drum 15 is coupled with a special electric motor or the photosensitive drum 11 through gears so as to be driven to rotate in the direction as shown by the illustrated arrow. The transfer drum 15 is surrounded by a transfer charger 17, toner charge controlling dischargers 19, a separation claw 20, dischargers 21, a cleaner 22, an absorbing opposite roll 23, and an absorbing charger 25. A transfer material is carried from the transfer material supply portion 4 to the transfer drum 15 through a subsidiary carrying roll 32 and a main carrying roll 31 constituting a transfer material carrying device 14, and absorbed into the dielectric sheet by corona discharge of the absorbing charger 25. The transfer drum 15 is rotated synchronously with the photosensitive drum 11, thereby transferring a toner image, developed with yellow as an example, to a transfer material by the transfer charger 17, and further transferring the other colors by the rotation of the transfer drum 15 sequentially.

After the transfer drum 15 rotates four times so that transferring of four colors is completed, the transfer material is discharged by the separating dischargers 19 provided inside and outside the transfer drum 15, separated by the separation claw 20, and carried to a fixer 29 by a carrying belt 27, and the toner image is fused and fixed by a heating and pressing roller 30. A copy cycle is thus completed.

In the above-mentioned transfer material carrying device 14, on/off timing of a clutch for driving the carrying rolls 31 and 32 is decided to absorb a transfer material into a dielectric sheet of the transfer drum 15 in order to surely carry the transfer material at predetermined timing. In such a case, there is a problem that if the transfer material is lagged in the carrying direction, the feeding the transfer material toward the absorbing surface of the photosensitive body is so unstable as to produce a clearance between the absorbing surface of the photosensitive body and the transfer material to thereby produce a transfer fault.

In order to solve this problem, as disclosed in Japanese Patent Post-Examination Publication No. Sho-60-27979, the subsidiary carrying roll 32 is driven before the main carrying roll 31 is driven so that a transfer material is bent to generate a loop, and the main carrying roll 31 is driven to align the leading edge of the transfer material if the quantity of this loop is normal, while the transfer material is discharged outside through another course if the quantity of the loop is not normal.

In the above-mentioned conventional system, however, the time from supplying a reference signal till transferring is predetermined in the case where control on the main carrying roll 31 is carried out on the basis of the reference signal obtained on the rotation position of the transfer drum. On the other hand, in delivering products or exchanging parts, the leading edge of a transfer material can reach a predetermined transfer point at different timings. Accordingly, even if read registration, that is, the main carrying roll 31 is operated it is necessary to adjust the above-mentioned read registration by changing the timing to start the operation of the main carrying roll 31.

This will be described with reference to FIG. 5. On the assumption that the initial value of the timing to start the operation of the subsidiary carrying roll 32 is $T_1$, and the initial value of the timing to start the operation of the main carrying roll 31 is $T_3$, setting is made so that a clutch for the subsidiary carrying roll is turned off after time $T_L$ which is taken for generation, of the optimum loop quantity, after a transfer material detecting sensor for detecting the fact that a transfer material has reached the position of the main carrying roll 31 is turned on at $T_2$, and thereafter a clutch for the main carrying roll is turned on. If the main carrying roll 31 starts running earlier as if the timing to start the operation of the main carrying roll 31 is not $T_3$ but $T_3'$ as a result of adjustment of the above-mentioned read registration in this state, a transfer material delayed to the extent not to be detected by jam detection is fed out from the main carrying roll 31 as the optimum loop quantity cannot be generated between the carrying rolls 31 and 32 since the loop quantity generating time is $T_L'$ so that there is produced a problem that the transfer material is delayed in the carrying direction to thereby produce such a transfer fault as mentioned above.

SUMMARY OF THE INVENTION

It is an object of the present invention to solve the foregoing problem, that is, in the case of adjusting the timing to start the operation of a main carrying roll on the basis of a reference signal based on the rotation of a transfer material holder, a jam production rate in the main carrying roll section is reduced and the reliability is improved by generating the optimum loop quantity in a transfer material fed from the main carrying roll, and saving a transfer material carried in delay as much as possible.

In order to attain the foregoing object, according to the present invention, in an image generating device of the multiplex transfer system having a transfer device for transferring a developed image on an electrostatic latent image carrier to a transfer material held on a transfer material holder, and a transfer material carrying device for carrying a transfer material to the transfer material holder; a transfer material carrying control apparatus is characterized in that the transfer material carrying device includes a main carrying roll for carrying a transfer material to the transfer material holder, a subsidiary carrying roll for transferring a transfer material to the main carrying roll to generate a loop, a transfer material detecting sensor provided close to the main carrying roll, and a jam judging timer for judging jam of a transfer material on the basis of a detection signal of the transfer material detecting sensor, whereby driving timing of the main carrying roll is controlled by a rotation position reference signal of the transfer material holder, and in the case of adjusting driving timing of the main carrying roll, the judging time of the jam judging timer and the driving timing of the subsidiary carrying roll are changed in accordance with the adjusted timing to thereby ensure the optimum quantity of the loop of the transfer material. The velocity of the subsidiary carrying roll may be increased when the transfer material is carried to the main carrying roll by the subsidiary carrying roll to generate the loop.

According to the present invention, when read registration is adjusted by adjusting the timing to start the operation of a main carrying roll on the basis of a reference signal based on the rotation of a transfer material holder, the adjusted time is fed back to the judging time for a jam judging timer and the timing to drive a subsidiary carrying roll, so that the optimum loop quantity is generated in a transfer material fed from the main carrying roll, and a transfer material carried in delay is saved as much as possible without reducing the number of transferred sheets per time, and fed to a transfer material holder from the main carrying roll in the state of the proper loop quantity. Thus, a jam production rate is reduced in the main carrying roll section.

DESCRIPTION OF THE PREFERRED EMBODIMENTS

Figure 1:
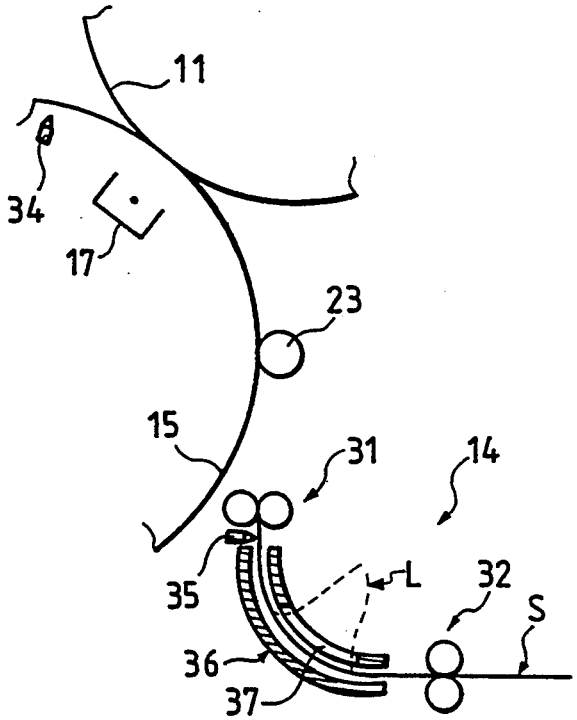
FIG. 1 is a configuration diagram illustrating an embodiment of a transfer material carrying control apparatus according to the present invention.
Figure 6:
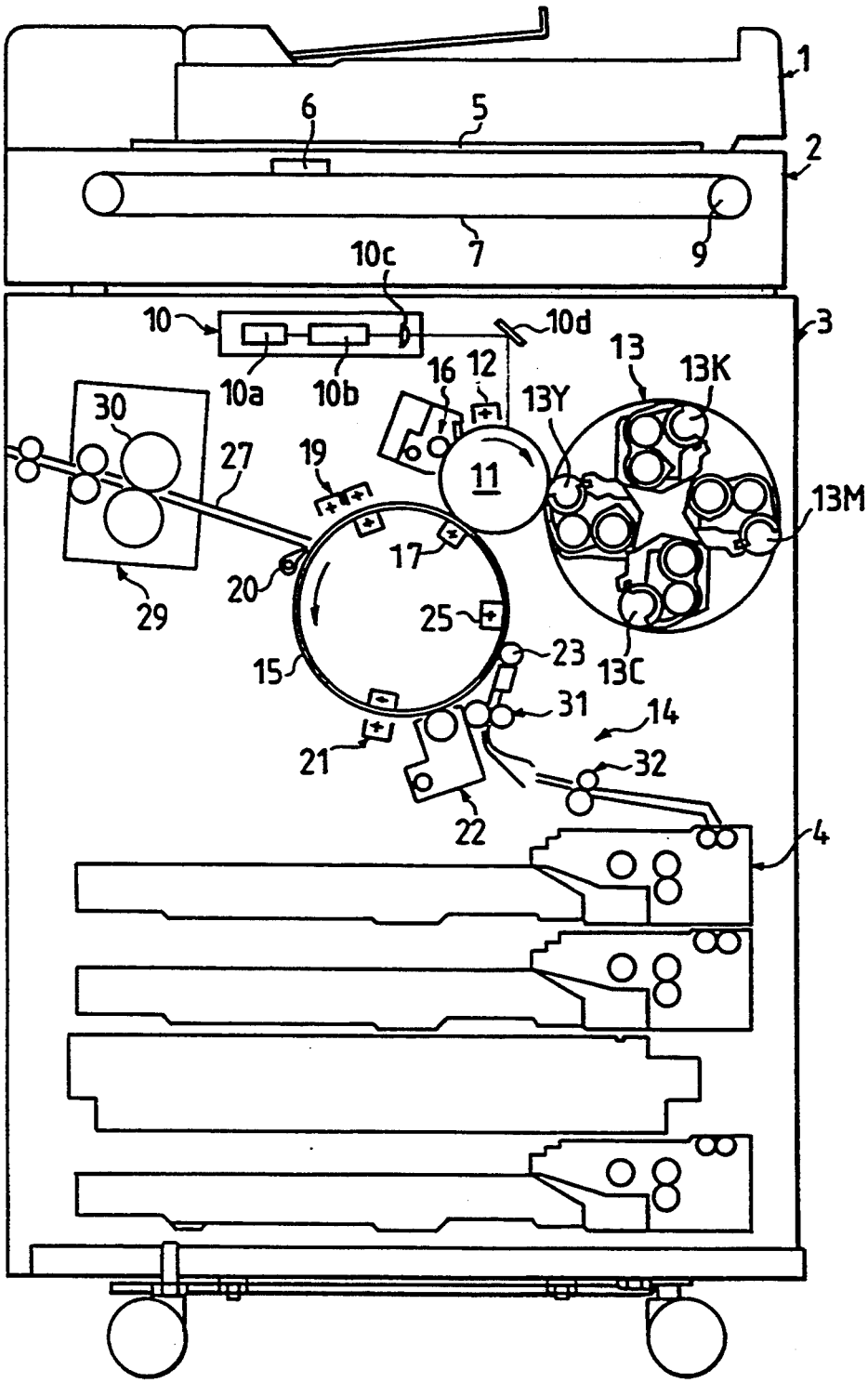
FIG. 6 PRIOR ART
FIG. 6 is a configuration diagram illustrating an example of an image generating device to which the present invention is applied.

An embodiment of the present invention will be described with reference to the drawings. FIG. 1 is a configuration diagram illustrating an embodiment of the transfer material carrying control apparatus according to the present invention. Although the present invention is applied preferably to the color electrophotographic copying machine which has been described with reference to FIG. 6, it can be applied to any other multiplex transfer system image generating devices.

In FIG. 1, a transfer drum 15 which rotates synchronously with a photosensitive drum 11 constituting an electrostatic latent image carrier is provided close to the photosensitive drum 11, and a transfer charger 17 is provided within the transfer drum 15, so that a developed image on the photosensitive drum 11 is transferred to a transfer material S held on the transfer drum 15. Further, a transfer drum rotation position detecting sensor 34 for detecting the rotation position of the transfer drum 15 is provided within the transfer drum 15.

A transfer material carrying device 14 includes a main carrying roll 31 for carrying the transfer material S toward the gap between the transfer drum 15 and an absorbing opposite roll 23, a subsidiary carrying roll 32 for carrying the transfer material S toward the main carrying roll 31, and a transfer material detecting sensor 35 provided close to the entrance side of the main carrying roll 31. A space portion 37 is generated on the upper side of a transfer material carrying guide 36, so that the transfer material S is bent so as to generate a loop L when the top of the transfer material S comes into contact with the main carrying roll 31, and the subsidiary carrying roll 32 is driven.

Figure 2:
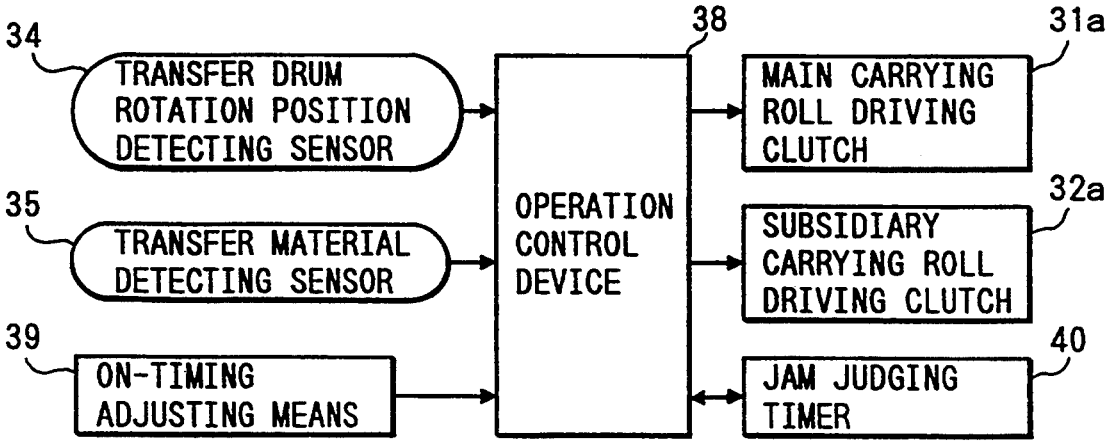
FIG. 2 is a configuration diagram of a control system in the present invention.

FIG. 2 shows a configuration diagram of a control system according to the present invention, in which signals of the transfer drum rotation position detecting sensor 34 and the transfer material detecting sensor 35 are supplied to an operation control device 38 in which on/off timing of main and subsidiary carrying roll driving clutches 31*a* and 32*a* are controlled through a control method which will be described later. Further, a signal of an on-timing adjusting means 39 of the main carrying roll driving clutch 31*a* is supplied to the operation control device 38, in which a setting value of a jam judging timer 40 and on-timing of the subsidiary carrying roll driving clutch 32*a* are changed by a method which will be described later. The jam judging timer 40 judges jam by comparing the setting value and a detection signal of the transfer material detecting sensor 35.

Figure 3:
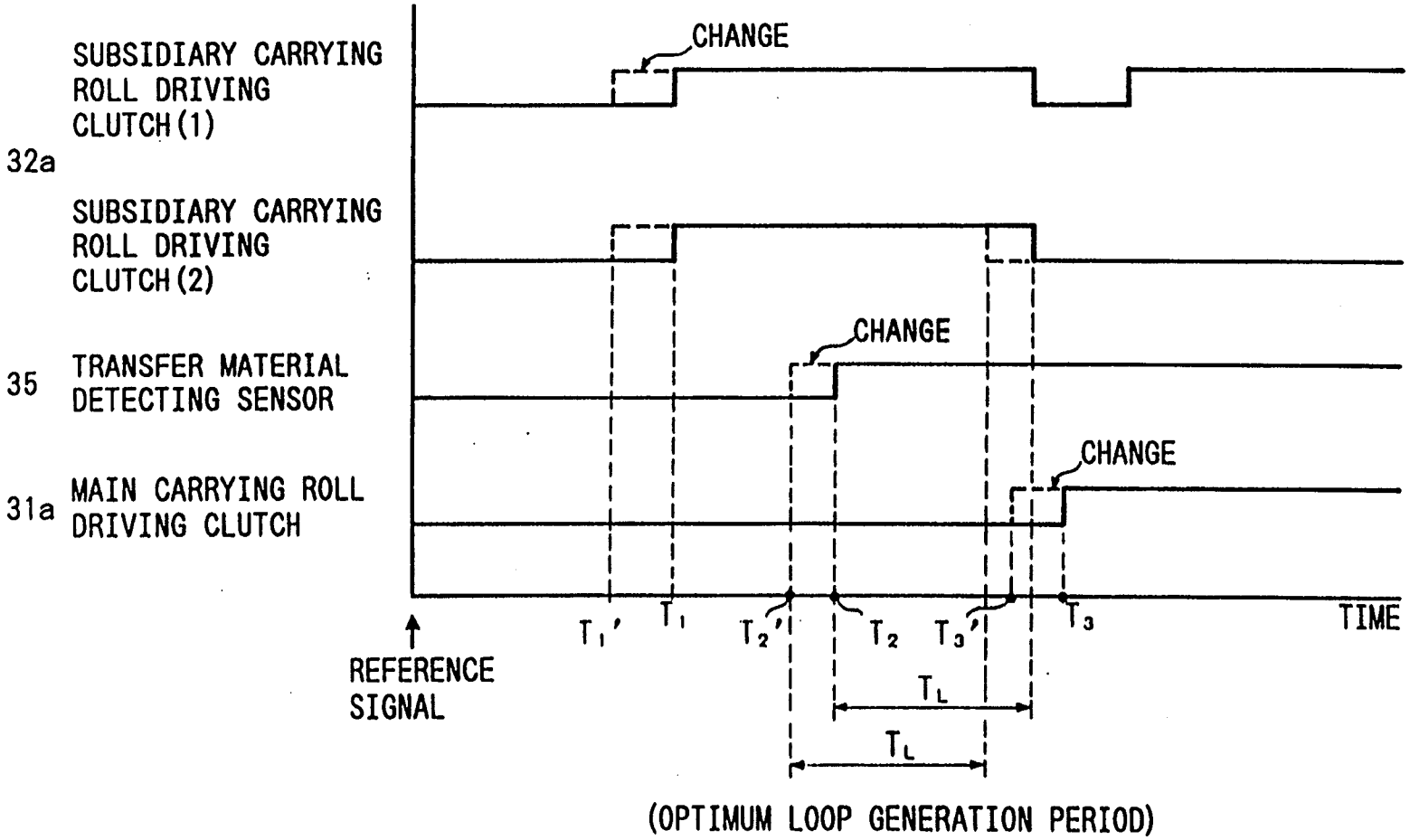
FIG. 3 is a diagram illustrating a timing chart of control in the present invention.

FIG. 3 shows a timing chart for control according to the present invention. In this embodiment, the subsidiary carrying roll driving clutch 32*a* is constituted by clutches (1) and (2), brought into an increased speed mode if both the clutches (1) and (2) are turned on, thereby shortening the time to carry a transfer material to the main carrying roll and generate a loop, while brought into a same speed mode as that of the main carrying roll 31 if only the clutch (1) is turned on, thereby assisting a transfer material in being carried, but only a clutch may be used.

On the assumption that the initial value of the on timing of the clutch 32*a* for driving the subsidiary carrying roll is $T_1$, and the initial value of the on-timing of the clutch 31*a* for driving the main carrying roll is $T_3$, setting is made so that the clutch 32*a* for the subsidiary carrying roll is turned off after time $T_L$ which is taken for generation of the optimum loop quantity, after a transfer material detecting sensor for detecting the fact that a transfer material has reached the position of the main carrying roll 31 is turned on at $T_2$, and thereafter the clutch 31*a* for the main carrying roll is turned on. In FIG. 3, $T_2$ represents an initial value of the jam judging timer 40, which judges there is a jam and indicates it to the outside if the transfer material detecting sensor exceeds $T_2$.

Figure 4:
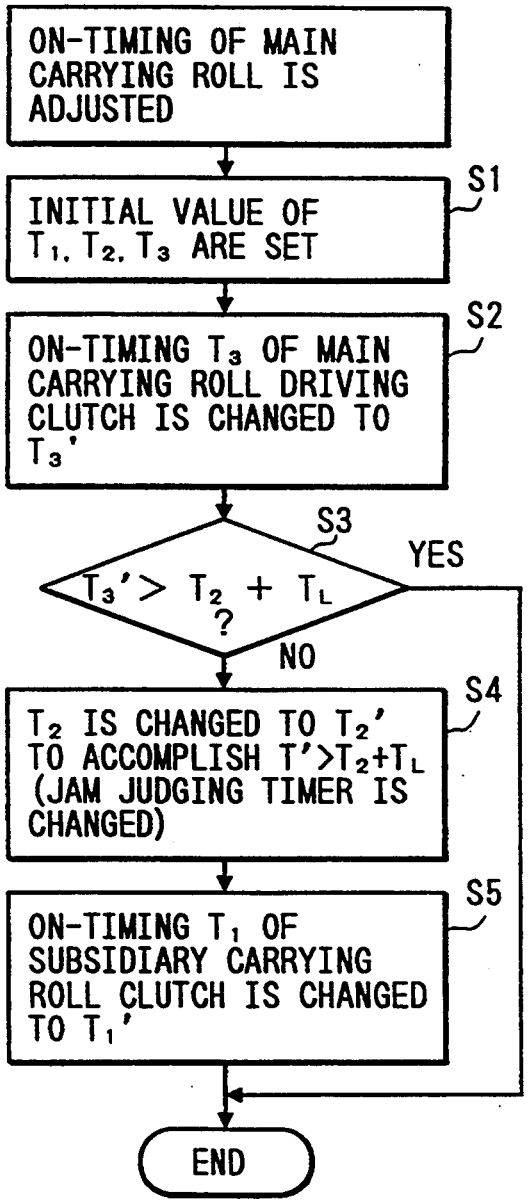
FIG. 4 is a diagram illustrating the flow of control processing in the present invention.
Figure 5:
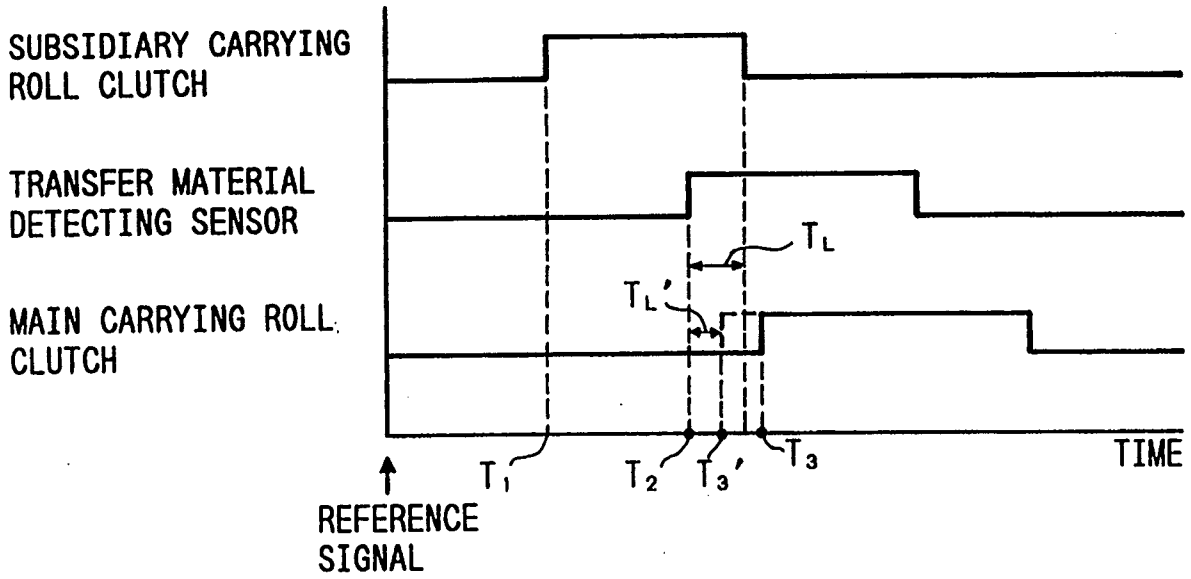
FIG. 5 PRIOR ART
FIG. 5 is a diagram for explaining the theme of the present invention.

The case of adjusting read registration in this state will be described with reference to FIG. 4. As mentioned above, the time from supplying a reference signal till transferring is predetermined in the case where control on the main carrying roll 31 is carried out on the basis of the reference signal obtained on the rotation position of the transfer drum. On the other hand, in delivering products or exchanging parts, there is variation in the time for the top of a transfer material to reach a predetermined transfer point even if read registration, that is, the main carrying roll 31 is operated for every product. Accordingly, it is necessary to adjust the timing to start the operation of the main carrying roll 31.

First, the initial value $T_1$ of on-timing of the subsidiary carrying roll driving clutch 32*a*, the initial value $T_2$ of the jam judging timer 40, and the initial value $T_3$ of on-timing of the main carrying roll driving clutch 31*a* are set in Step S1, and the initial value $T_3$ is changed into $T_3'$ in Step S2 if it is necessary to change the initial value $T_3$ of on-timing of the main carrying roll driving clutch 31*a*.

In Step S3 it is judged whether $T_3'$ is larger than $T_2+T_L$ or not, and if NO, that is, if on-timing of the main carrying roll driving clutch 31*a* is $T_3'$ as shown in FIG. 3, the initial value $T_2$ of the jam judging timer 40 is changed into $T_2'$ to make $T_3'$ larger than $T_2+T_L$ in Step S4, and the initial value $T_1$ of on-timing of the subsidiary carrying roll driving clutch 32*a* is also changed into $T_1'$ in Step S5.

If $T_3'$ is larger than $T_2+T_L$ in Step S3, the changing in Steps S4 and S5 is unnecessary since the optimum loop quantity generating time $T_L$ is ensured. Therefore, a transfer material carried with more or less delay is saved as much as possible, and fed to the transfer drum 15 from the main carrying roll 31 in the state of a proper loop quantity, so that the jam production rate can be reduced in the portion of the main carrying roll 31, and the reliability can be improved.

As a specific example:

(A) Carrying speed to the subsidiary carrying roll 32:164.7 mm/sec (B) Carrying speed to the main carrying roll 31: 266 mm/sec (C) Carrying speed in the main carrying roll 31: 160.81 mm/sec (D) Initial value $T_2$ of the jam judging timer 40: 1470 ms (E) Initial value $T_3$ of on-timing of the main carrying roll driving clutch 31*a* : 1543 ms (F) Optimum loop quantity generating time $T_L$: 68 ms (fixed)

Time of (A) is changed if (D) is reduced to establish (E)>(D)+(F). For example, in the case of adjusting read registration by making the initial value $T_3$ of on-timing of the main carrying roll driving clutch 31*a* in (E) earlier by 10 msec, it is possible to attain the optimum control by shortening 1470 ms of (D) by 6 ms and prolonging the time of (A) by 10 msec because of fixed (F).

As is apparent from the above description, according to the present invention, in a multiplex transfer system image generating device, a transfer material carrying device includes a main carrying roll for carrying a transfer material to the transfer material holder, a subsidiary carrying roll for transferring a transfer material to the main carrying roll to generate a loop, a transfer material detecting sensor provided close to the main carrying roll, and a jam judging timer for judging jam of a transfer material on the basis of a detection signal of the transfer material detecting sensor, whereby driving timing of the main carrying roll is controlled by a rotation position reference signal of the transfer material holder, and in the case of adjusting driving timing of the main carrying roll, the judging time of the jam judging timer and the driving timing of the subsidiary carrying roll are changed in accordance with the adjusted timing to thereby ensure the optimum quantity of the loop of the transfer material, so that the optimum loop quantity is generated in a transfer material fed from the main carrying roll, and a transfer material carried in delay is saved as much as possible, and jam production rate in the main carrying roll section can be reduced as much as possible to thereby improve the reliability.

What is claimed is:

1. In an image generating device of a multiplex transfer system having a transfer device for transferring a developed image on an electrostatic latent image carrier to a transfer material held on a transfer material holder, and a transfer material carrying device for carrying a transfer material to said transfer material holder, the improvement wherein:

(a) said transfer material holder comprises a transfer drum having a transfer drum rotation position detecting sensor for detecting the rotation position of said transfer drum;

(b) said transfer material carrying device comprises a main carrying roll for carrying a transfer material to said transfer drum and having an on-timing adjusting means for adjusting the driving timing of said main roll, a subsidiary carrying roll for transferring the transfer material to said main carrying roll so as to generate a loop of the transfer material, a transfer material detecting sensor adjacent said main carrying roll, and a jam judging timer for judging jam of transfer material based on a detection signal from said transfer material detecting sensor; and (c) there is further included a transfer material carrying control device having means for receiving signals from each of said transfer drum rotation position detecting sensor, said transfer material detecting sensor and said on-timing adjusting means, and means for adjusting the driving timing of said main carrying roll in response to said signal from said rotation position detecting sensor and changing the judging timing of said judging timer and the driving timing of said subsidiary carrying roll in accordance with an adjusted driving timing of said main carrying roll to thereby ensure the optimum quantity of the loop of transfer material.

2. The image generating device of claim 1, further including clutch means for driving each of said main and subsidiary carrying rolls and wherein said transfer material carrying control device supplies a signal to said clutch means to cause the velocity of said subsidiary carrying roll to increase when the transfer material is carried to said main carrying roll by subsidiary carrying roll so as to generate said loop of transfer material.

* * * * *